US008047083B2

(12) United States Patent
Puzio et al.

(10) Patent No.: US 8,047,083 B2
(45) Date of Patent: Nov. 1, 2011

(54) TRIGGER ASSEMBLY INCLUDING A FLEXIBLE BEND SENSOR

(75) Inventors: Daniel Puzio, Baltimore, MD (US); Qiang J. Zhang, Lutherville, MD (US); Aris C. Cleanthous, Baltimore, MD (US); Stephen Alan Debelius, New Freedom, PA (US); Gabriel Eduardo Concari, Eldersburg, MD (US); Michael Kenneth Forster, White Hall, MD (US); David C. Tomayko, Ellicott City, MD (US); James B. Watson, Fallston, MD (US); Kenneth David Long, Fallston, MD (US); Daniele C. Brotto, Baltimore, MD (US)

(73) Assignee: Black & Decker Corporation, Newark, DE (US)

( * ) Notice: Subject to any disclaimer, the term of this patent is extended or adjusted under 35 U.S.C. 154(b) by 347 days.

(21) Appl. No.: 12/372,345

(22) Filed: Feb. 17, 2009

(65) Prior Publication Data

US 2010/0206703 A1 Aug. 19, 2010

(51) Int. Cl.
*B25B 23/14* (2006.01)

(52) U.S. Cl. ..... 73/862.21

(58) Field of Classification Search ..... 73/760, 73/777, 849, 862.21, 862.26, 862.325
See application file for complete search history.

(56) References Cited

U.S. PATENT DOCUMENTS

| | | | | |
|---|---|---|---|---|
| 3,386,067 | A | 5/1968 | Costanzo | |
| 3,651,391 | A | 3/1972 | Vogelsberg | |
| 4,275,521 | A * | 6/1981 | Gerstenberger et al. | 42/84 |
| 4,814,753 | A * | 3/1989 | Coppola | 340/689 |
| 5,012,817 | A * | 5/1991 | Zeilinski et al. | 600/557 |
| 5,014,793 | A | 5/1991 | Germanton et al. | |
| 5,086,785 | A | 2/1992 | Gentile et al. | |
| 5,309,135 | A | 5/1994 | Langford | |
| 5,365,155 | A | 11/1994 | Zimmermann | |
| 5,583,476 | A | 12/1996 | Langford | |
| 5,625,333 | A | 4/1997 | Clark et al. | |
| 5,965,827 | A | 10/1999 | Stanley et al. | |
| 6,040,542 | A | 3/2000 | Wolfe | |
| 6,774,509 | B2 | 8/2004 | Chu | |
| 2005/0248320 | A1 * | 11/2005 | Denning | 320/141 |
| 2007/0293781 | A1 * | 12/2007 | Sims et al. | 600/534 |

FOREIGN PATENT DOCUMENTS

| | | |
|---|---|---|
| EP | 0 423 673 | 12/1994 |
| GB | 2328630 | 6/1997 |

OTHER PUBLICATIONS

Title "Bender Sensor® Technology Electronic Interface Design Guide"; Copyright © 1997 Flexpoint Sensor Systems, Inc., SEG040404B, pp. 1-14, 1997.

Title "Bender Sensor® Technology Mechanical Application Design Guide"; Copyright © 1997 Flexpoint Sensor Systems, Inc., SEG040404, pp. 1-10, 1997.

* cited by examiner

*Primary Examiner* — Max Noori

(74) *Attorney, Agent, or Firm* — Amir Rohani

(57) ABSTRACT

A flexible sensor is disposed in a power tool. The flexible sensor has an electrical resistance that varies based on a radius of curvature of the flexible sensor. A trigger partially disposed in the power tool, operates to apply a bending force at an engagement point on the flexible sensor to bend the flexible sensor and alter the radius of curvature. A controller outputs an electrical signal to the power tool based on the electrical resistance to control a function of the power tool.

18 Claims, 11 Drawing Sheets

TRIGGER ASSEMBLY INCLUDING A FLEXIBLE BEND SENSOR

FIELD

The present disclosure relates to a trigger assembly including a flexible sensor.

BACKGROUND

This section provides background information related to the present disclosure which is not necessarily prior art.

Trigger assemblies are used to control functions of power tools. Existing trigger assemblies can include a variety of sensing devices to translate the movement of the trigger into control of the power tool. The trigger assemblies are often bulky due to the sensing devices. The size and shapes of the trigger assemblies hinder improvement to ergonomic aspects of the design of the power tool. Furthermore, existing trigger assemblies provide limited, linear control and control only one function of the power tool at a time. Therefore, a user of the power tool is required to use one hand to activate the trigger and another hand to change the function of the trigger. Productivity of the user decreases due to delays from switching the tool functionality and uncomfortable ergonomics.

SUMMARY

This section provides a general summary of the disclosure, and is not a comprehensive disclosure of its full scope or all of its features.

A flexible sensor is provided with a power tool. The flexible sensor has a variable electrical resistance that changes based on a radius of curvature of the flexible sensor. A trigger connected to the power tool operates to apply a bending force at an engagement point on the flexible sensor to bend the flexible sensor and create the radius of curvature. A controller outputs an electrical signal to the power tool based on the electrical resistance to control a function of the power tool.

A second flexible sensor can be provided with the power tool. The second flexible sensor has a second variable electrical resistance that changes based on a second radius of curvature of the second flexible sensor. The trigger operates to apply a bending force at an engagement point to bend the second flexible sensor and create the second radius of curvature. The controller outputs a second electrical signal to the power tool based on the second electrical resistance to control a second function of the power tool.

A second trigger can be connected with the power tool and can operate to apply a second bending force at a second engagement point to bend the second flexible sensor and create the second radius of curvature. The controller outputs a second electrical signal to the power tool based on the second electrical resistance to control a second function of the power tool.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure. Corresponding reference numerals indicate corresponding parts throughout the several views of the drawings.

Example embodiments will become more fully understood from the detailed description below and the accompanying drawings, wherein like elements are represented by like reference numerals, which are given by way of illustration only.

DETAILED DESCRIPTION

Example embodiments will now be described more fully with reference to the accompanying drawings.

Figure 1:
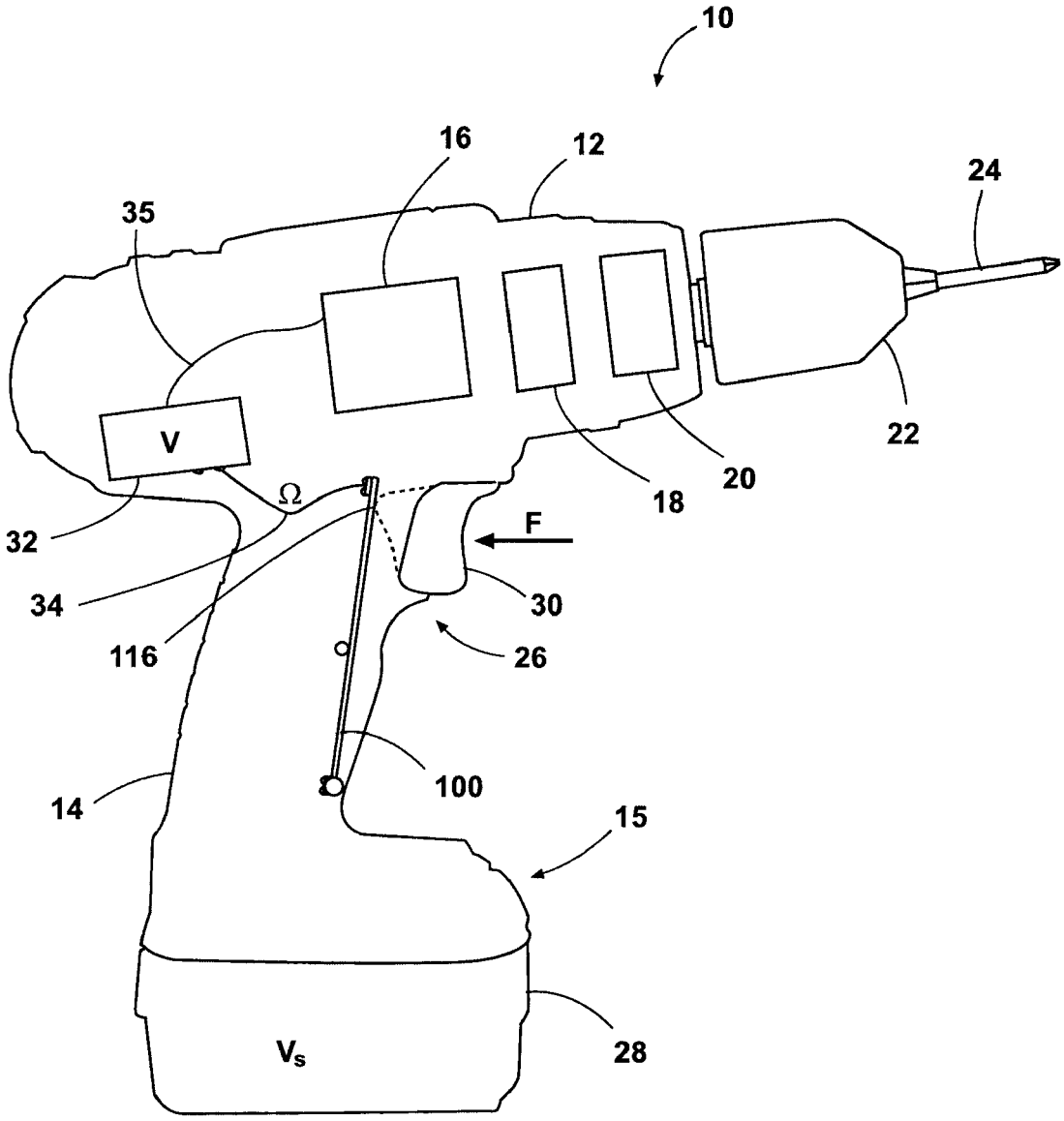
FIG. 1 is a side elevational view of a power tool according to an example embodiment.

Referring to FIG. 1, a power tool 10 includes a drive end 12 and a handle 14. The drive end 12 can include a motor 16, a gear set 18, and a clutch 20. The gear set 18 may include a transmission gear set. The motor 16 causes the gear set 18 to rotate. A chuck 22 attached to the clutch 20 facilitates attachment of a bit 24. The power tool 10 can be a bit driver adapted to receive a variety of bits including but not limited to a drill bit, a screwdriver bit, and a nut driver bit.

The handle 14 can include a trigger assembly 26 and can further provide for attachment of a power source 28 at a distal end 15 of the handle 14. The power source 28 can be a battery pack or another power source including an alternating current power source. The handle 14 can be transversely connected to the drive end 12, forming a pistol-grip configuration as in a power drill. In another embodiment, the handle 14 and the drive end 12 can be connected in-line to form a linear configuration. The linear configuration may be a motor-grip style power tool in which the motor 16 is gripped by the user, such as the power screwdriver 10' shown in FIG. 15.

The trigger assembly 26 can include a trigger 30 and a flexible bend (flex) sensor 100. The trigger 30 can be a pistol-trigger, push-button trigger, a rocker-trigger, or other input member. The trigger 30 can move relative to the handle 14 to activate the power tool 10 by application of an input force (F) on the trigger 30. As the trigger 30 travels toward the handle 14 due to the input force (F), the trigger 30 contacts the flex sensor 100. The trigger 30 translates the input force (F) to the flex sensor 100 where the input force (F) is converted into a bending force, equal in magnitude to the input force (F), to cause the flex sensor 100 to bend at an engagement point 116. The input force (F) and the bending force are treated as the same force (F) throughout the present disclosure.

The flex sensor 100 has a variable output that can change as the flex sensor 100 is bent. The variable output can be a variable electrical resistance (Ω) measurable in Ohms. The flex sensor 100 can be connected to a controller 32 by an electrical connection 34. The power source 28 supplies power to the controller 32. The controller 32 and the flex sensor 100 can operate together as a voltage divider circuit to produce a voltage output (V) that is a fraction of a power source voltage ($V_S$). Bending the flex sensor 100 by application of the bending force (F) changes the resistance (Ω) of the flex sensor 100. The variable resistance (Ω) can vary linearly or non-linearly with respect to a degree of bending of the flex sensor 100. The change in resistance (Ω) of the flex sensor 100 causes a corresponding change in the voltage output (V) of the controller 32.

The voltage output (V) is used to control a function of a component of the power tool 10. The controller 32 can be electrically connected to the component by electrical leads 35. The component can be the motor 16, the gear set 18, the clutch 20, or any other component associated with the power tool 10. The function can be a speed of the motor 16, a rotational direction of the gear set 18, a torque limit of the clutch 20, and the like.

Figure 2:
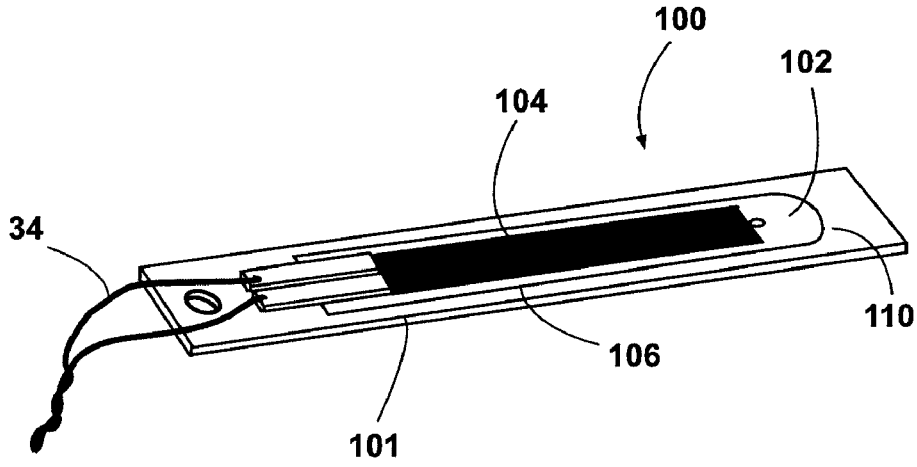
FIG. 2 is a top perspective view of a flex sensor disposed on a leaf spring in a rest position.
Figure 3:
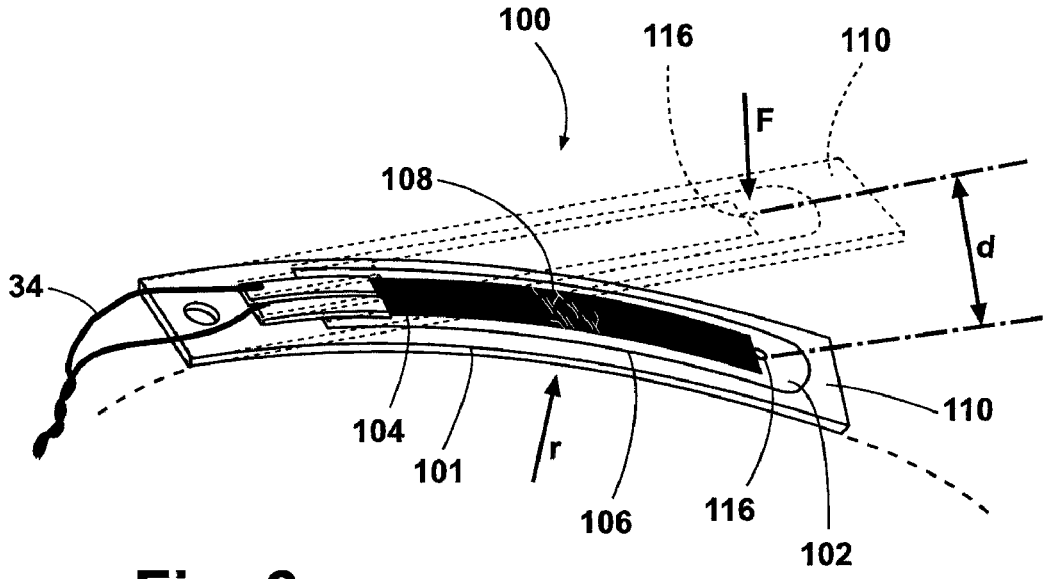
FIG. 3 is a top perspective view of the flex sensor of FIG. 2 disposed on a leaf spring in a bent position.

Referring to FIGS. 2 and 3, and also to FIG. 1, the flex sensor 100 can be a substantially flat sensor that can be selected from a variety of lengths, widths and/or thicknesses. The flex sensor 100 can include a substrate 102 coated in part with an ink 104. The substrate 102 can be a plastic film such as a biaxially-oriented polyethylene terephthalate film, a polyimide film, or the like. The ink 104 can be a carbon-based ink, a polymer based ink, a composite ink, or the like. The ink 104 can also be electrically conductive. The ink 104 can include a brittle component and a flexible component. An example of a suitable flex sensor is the Bend Sensor® potentiometer from Flexpoint Sensor Systems, Inc. of Draper, Utah.

The flex sensor 100 can also include a leaf spring 110 so that it takes on the mechanical properties of the leaf spring 110. The leaf spring 110 can be flat-shaped and bendable. The flex sensor 100 can be laminated and/or attached by an adhesive 106 to the leaf spring 110. The resistance (Ω) of the flex sensor 100 is at a base level resistance when the flex sensor 100 is in a rest position as in FIG. 2. The rest position can also be defined with the flex sensor 100 initially bent depending on the geometry of the handle 14. The base level resistance is defined as a minimum resistance of the flex sensor 100 as used by the power tool 10.

With the application of the input force (F) in FIG. 3, flex sensor 100 bends away from the rest position, which causes micro-cracks 108 to form in the ink 104 of the flex sensor 100. The micro-cracks 108 form due to cracking of the brittle component of the ink 104 while the flexible component maintains the overall integrity of the ink 104. The micro-cracks 108 in the ink 104 cause the electrical resistance (Ω) of the flex sensor 100 to change when connected by connection 34 to the controller 32. As the degree of bending increases due to the input force (F), more micro-cracks 108 form in the ink 104 causing the resistance (Ω) of the flex sensor 100 to increase. The resistance (Ω) can vary based on the magnitude of the input force (F) applied to the trigger 30. The controller 32 varies the voltage output (V) based on the resistance (Ω) to direct a function of the power tool 10.

In FIGS. 3 and 17-20, the degree of bending is defined as a radius of curvature (r) that is formed by an outer edge 101 of the flex sensor 100 in the bent position. The radius of curvature (r) is the radius of a circle approximating the edge 101 of the bent flex sensor 100. The smaller the radius of curvature (r) is, the larger the resistance (Ω) of the flex sensor 100. The degree of bending can also be defined by a deflection (d) of the flex sensor 100. The deflection (d) is the distance between the engagement point 116 while the flex sensor 100 is in the rest position and the engagement point 116 while the flex sensor 100 is in the bent position. The larger the deflection (d) is, the larger the resistance (Ω) of the flex sensor 100.

The flex sensor 100 can be repeatedly bent because the ink 104 continues to have a strong bond to the substrate 102. The resistance (Ω) of the flex sensor 100 returns to the base level resistance when the input force (F) is released and the flex sensor 100 returns to the rest position.

Figure 4:
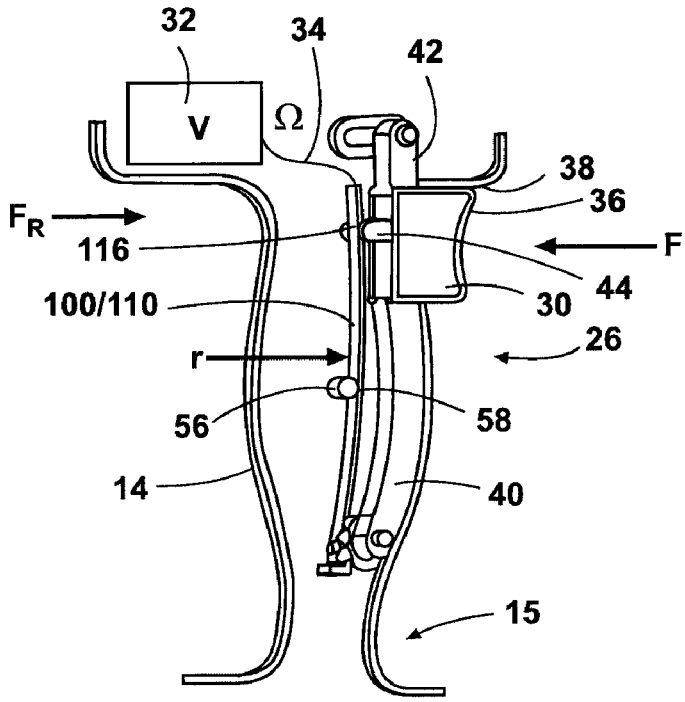
FIG. 4 is a side elevational view of a trigger assembly including a flex sensor of the present disclosure.
Figure 5:
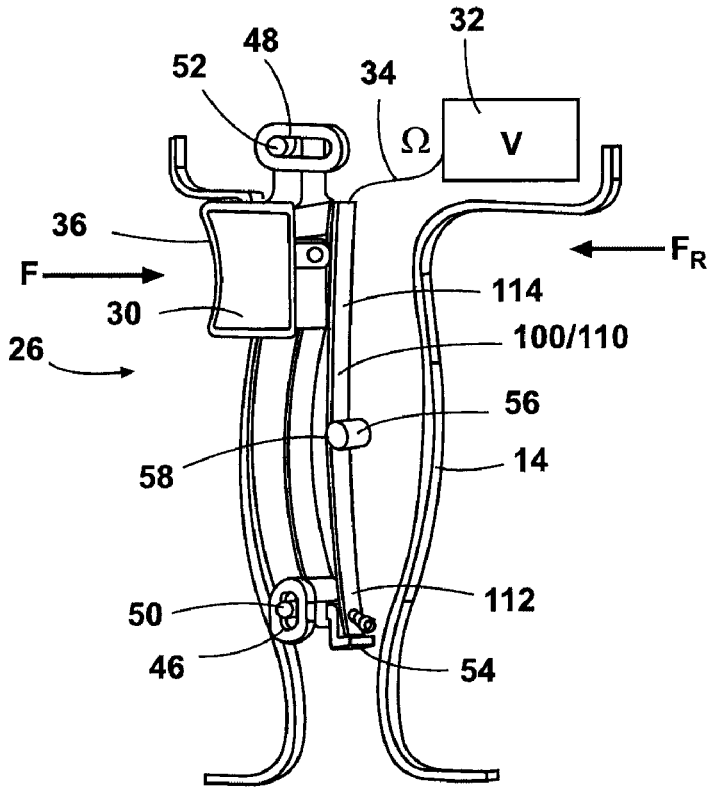
FIG. 5 is a side elevational view of an opposite side of the trigger assembly of FIG. 4.

Referring to FIGS. 4 and 5, the trigger assembly 26 is provided with the handle 14. The trigger assembly 26 includes the trigger 30 and the flex sensor 100. The trigger 30 has a finger support 36 extending outside of the handle 14 through a trigger opening 38. The finger support 36 allows a user to apply the input force (F) to operate the power tool 10. The trigger 30 includes a lower arm 40 extending toward the distal end 15 of the handle 14. The trigger 30 also includes an upper arm 42 extending away from the distal end 15. Both the lower arm 40 and the upper arm 42 support the trigger 30 in the handle 14. A bridge 44 can project from the finger support 36 in a direction substantially transverse to the lower and the upper arms 40 and 42, respectively. The bridge 44 transfers the input force (F) from the finger support 36 to the flex sensor 100.

A first cam slot 46 and a second cam slot 48 are provided in the handle 14. The lower and the upper arms 40 and 42 include pins 50 and 52 inserted into the first and second cam slots 46 and 48, respectively. The first and second cam slots 46 and 48 provide a travel path of the trigger 30 that is less arcuate and therefore creates a more linear trigger motion. For example, when a user applies the input force (F) to the finger support 36, the trigger 30 pivots about the pin 50 guided by the first cam slot 46. However, rather than pure rotation at the first cam slot 46, some translation also occurs at the first cam slot 46 as the trigger motion is influenced by the pin 52 in the second cam slot 48. The first and second cam slots 46 and 48 also limit the travel of the trigger 30.

The flex sensor 100 can be provided in the handle 14. By way of example only, the flex sensor 100 is oriented parallel to the lower and the upper arms 40 and 42 of the trigger 30. The flex sensor 100 can be pre-loaded to a bent rest position to help keep the flex sensor 100 secured in the handle 14.

Figure 17:
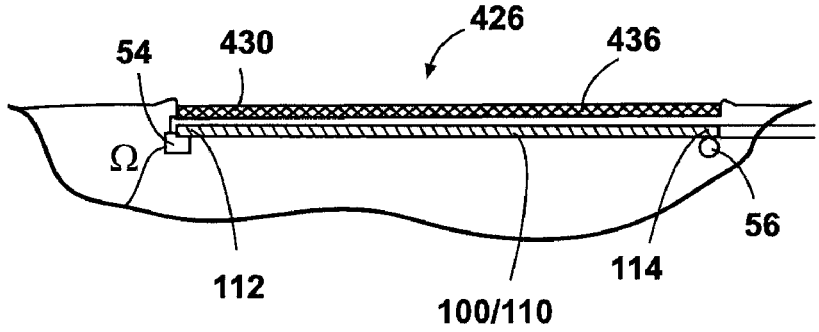
FIG. 17 is a side elevational view of the trigger assembly of FIG. 16 in a rest position.
Figure 18:
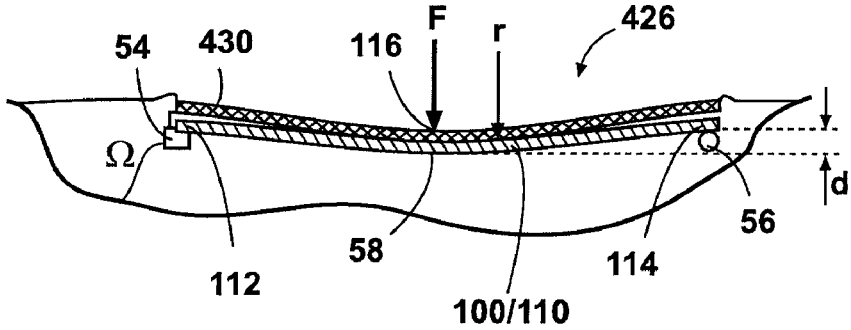
FIG. 18 is a side elevational view of the trigger assembly of FIG. 17 in a bent position.

A spring support 54 is fixed in the handle 14 to support a supported end 112 of the flex sensor 100. The bridge 44 of the trigger 30 can contact a free end 114 of the flex sensor 100 at the engagement point 116. A pivot 56 can be provided in the handle 14 at an intermediate position 58 between the engagement point 116 and the spring support 54. The pivot 56 can also be located nearer the free end 114 of the flex sensor 100 as shown in FIGS. 17 and 18. In this manner, the engagement point 116 can be located at the intermediate position 58 between the spring support 54 and the pivot 56.

When a user applies the input force (F) to the trigger 30 (e.g., a finger pull), the force is transferred by the bridge 44 to the flex sensor 100 at the engagement point 116. As the trigger 30 moves inside the trigger opening 38, the flex sensor 100 elastically bends to the radius of curvature (r) described in reference to FIG. 3. The pivot 56 guides the direction of bending of the flex sensor 100 around the pivot 56 and can decrease the radius of curvature (r) (increase the bending) of the flex sensor 100. The flex sensor 100 can include the leaf spring 110 to provide a return spring force ($F_R$) oppositely directed with respect to the input force (F) for the trigger 30. The return spring force ($F_R$) provides a tactile feedback to the user and returns the trigger 30 outward from the handle 14.

The electrical resistance (Ω) of the flex sensor 100 increases as the radius of curvature (r) decreases due to the application of the input force (F) on the trigger 30 and the resultant bending of the flex sensor 100. The variable resistance (Ω) of the flex sensor 100 is sensed by the controller 32. The controller 32 uses the electrical resistance (Ω) to output a voltage (V) corresponding to a variable speed control input for the motor 16, shown and described in reference to FIG. 1.

Figure 6:
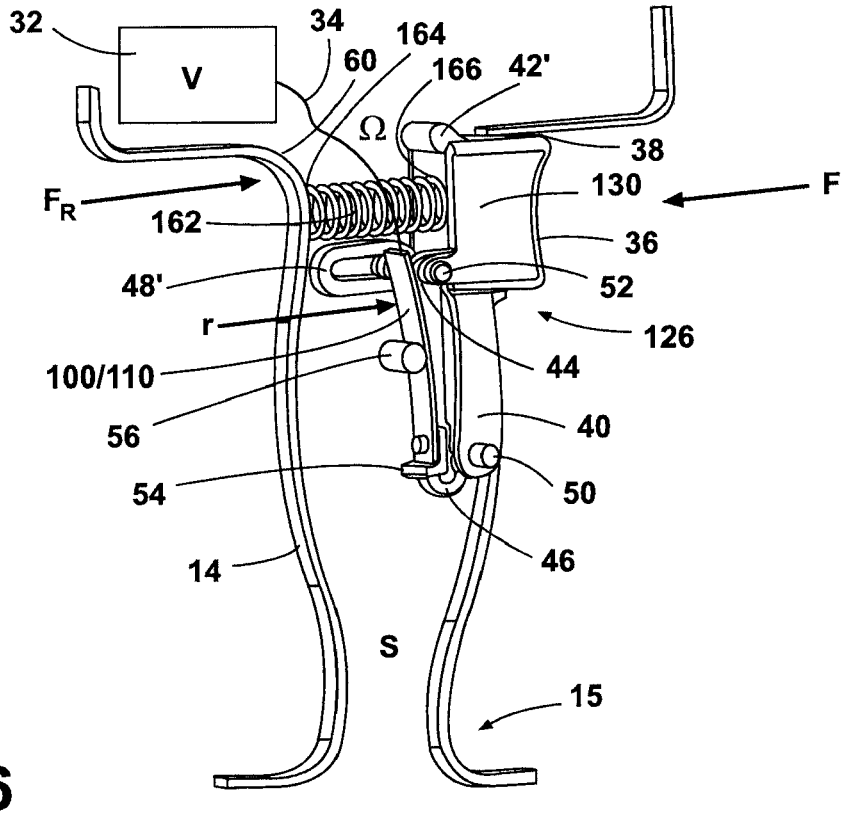
FIG. 6 is a side elevational view of a trigger assembly according to an example embodiment.
Figure 7:
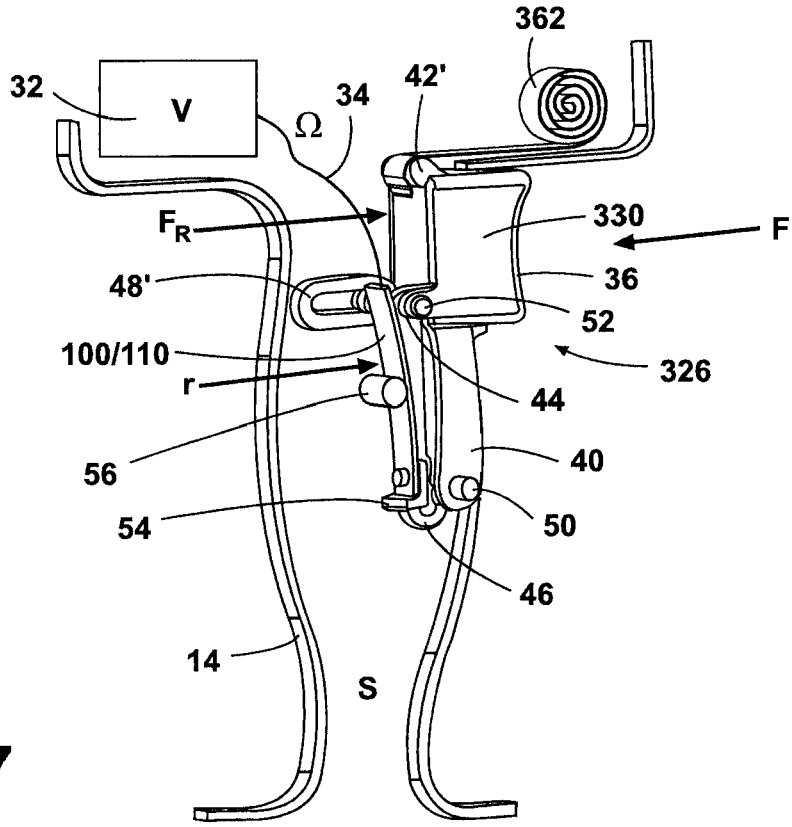
FIG. 7 is a side elevational view of a modification of the embodiment of the trigger assembly of FIG. 6.

Referring to FIGS. 6 and 7, trigger assemblies 126 and 326 are similar to trigger assembly 26 of FIGS. 4 and 5. However, in both FIGS. 6 and 7, the flex sensor 100 is shorter in length than in FIGS. 4 and 5. In this way, a reduced volume trigger assembly can be provided, creating an open space (S) in the distal end 15 of the handle 14. The flex sensor 100 can include the leaf spring 110 to provide a light return spring force ($F_R$) or no return spring force for triggers 130 or 330.

As shown in FIG. 6, trigger assembly 126 includes a coil spring 162 to provide the return spring force ($F_R$) for the trigger 130. The coil spring 162 is disposed between the trigger 130 and an inner wall 60 of the handle 14. Supports (not shown) can be provided in the handle 14 and the trigger 130 to support free ends 164, 166 of the coil spring 162. In this embodiment, the upper arm 42' is shortened in length compared to the upper arm 42 of FIGS. 4 and 5, and the second cam slot 48' can be located lower in the handle 14 towards the distal end 15. The pin 52 can be located within the bridge 44. The pin 52 and the bridge 44 can be separate items or combined in a unitary construction.

As shown in FIG. 7, trigger assembly 326 includes a constant force spring 362. The constant force spring 362 can be disposed above the trigger 330 as shown in FIG. 7. The constant force spring 362 acts against the upper arm 42' of the trigger 330 to provide the return spring force ($F_R$) for the trigger 330. For example, the constant force spring 362 can be a negator style or clock type spring. The constant force spring 362 provides a smoother control feature and decreases the input force (F) required of the user.

Figure 8:
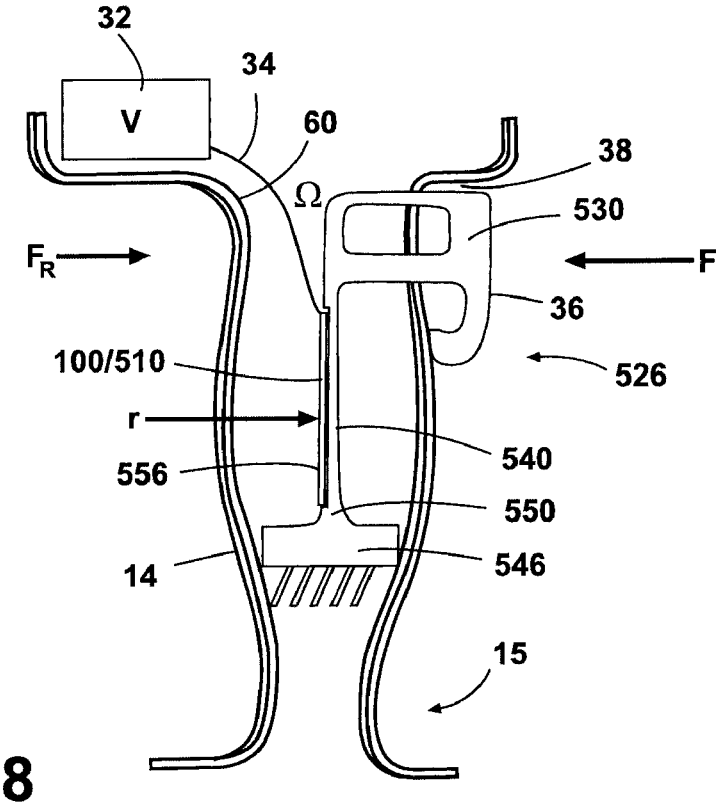
FIG. 8 is a side elevational view of a trigger assembly according to an example embodiment.

Referring to FIG. 8, a trigger assembly 526 includes a trigger 530 and the flex sensor 100. A trigger 530 includes the finger support 36, a lower member 540 extending from the finger support 36 towards the distal end 15 of the power tool 10, and a base 546 formed at a distal end 550 of the lower member 540. The base 546 can be fixed in the handle 14. The lower member 540 can be tapered such that it becomes wider towards the distal end 550 where it attaches to the base 546. The trigger 530, the lower member 540, and the base 546 can be of an integral, one-piece construction, for example, formed of a molded plastic.

In FIG. 8, trigger assembly 526 implements the flex sensor 100 on a surface 510 of the lower member 540. For example, the flex sensor 100 can be attached to the surface 510 of the lower member 540 by insert molding or over-molding. When a user applies the input force (F) to the trigger 530, the lower member 540 bends towards the inner wall 60 of the handle 14 to create the radius of curvature (r) in the flex sensor 100. The electrical resistance (Ω) of the flex sensor 100 increases as the radius of curvature (r) decreases due to the application of the input force (F) on the trigger 530. The elasticity of the lower member 540 acts against the input force (F) and provides the return spring force ($F_R$) for the trigger 530.

Figure 9:
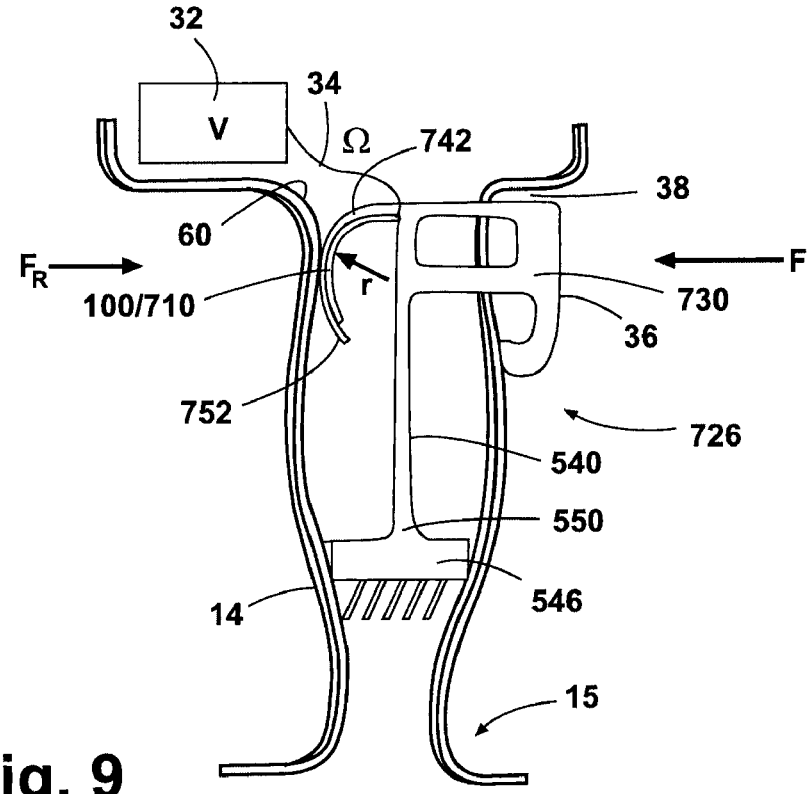
FIG. 9 is a side elevational view of a trigger assembly according to an example embodiment.

Referring to FIG. 9, another trigger assembly 726 is similar to the trigger assembly 526 in FIG. 8. Trigger assembly 726, however, implements the flex sensor 100 on a surface 710 of a curved upper member 742 of a trigger 730. An upper member 742 protrudes laterally towards the inner wall 60 of the handle 14. A distal end 752 of the upper member 742 curves toward the distal end 15 (or, alternatively, away from the distal end 15) of the power tool 10. The flex sensor 100 can be attached to the surface 710 of the upper member 742 by insert molding or over-molding. The flex sensor 100 can be bent to a radius of curvature (r) in the rest position corresponding to a curvature of curved upper member 742.

When a user applies the input force (F) to the trigger 730, the upper member 742 contacts the inner wall 60 and bends in a curved manner matching the curvature of distal end 752. The radius of curvature of the surface 710 decreases as the upper member bends, causing the radius of curvature (r) of the flex sensor 100 to decrease. The elasticity of the upper member 742 acts against the input force (F) and provides the return spring force ($F_R$) for the trigger 730.

Referring to FIGS. 6-9, the electrical resistance (Ω) of the flex sensor 100 increases as the radius of curvature (r) decreases due to the input force (F). The variable resistance (Ω) of the flex sensor 100 is sensed by the controller 32. The controller 32 uses the electrical resistance (Ω) to control the voltage (V) output corresponding to the control input for the component of the power tool 10 as in FIG. 1.

Figure 10:
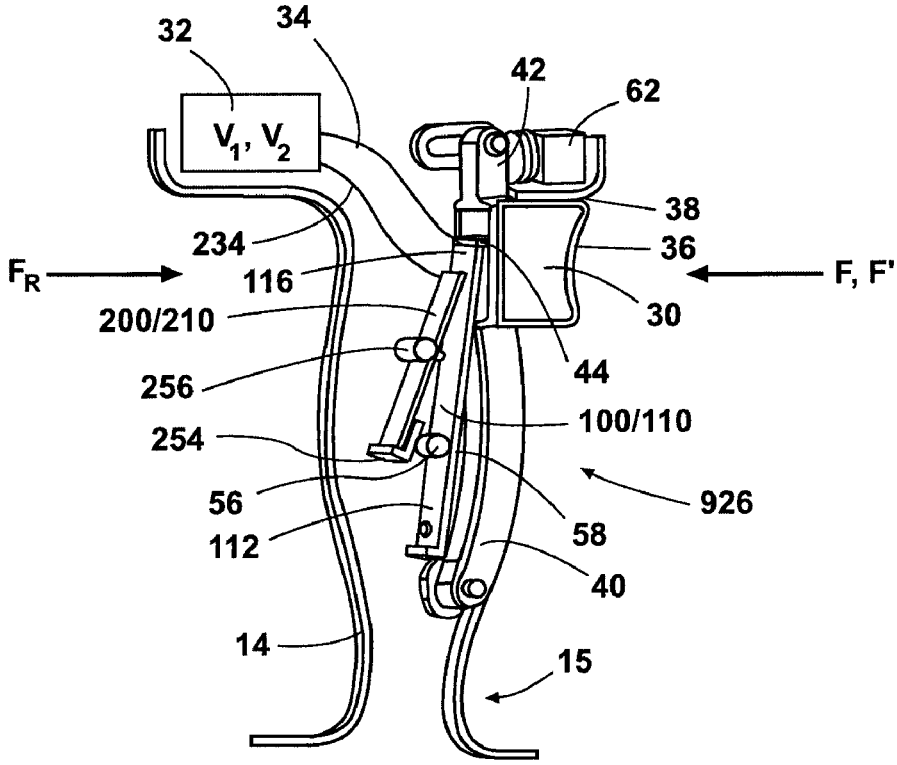
FIG. 10 is a side elevational view of a trigger assembly including two flex sensors according to an example embodiment.
Figure 11:
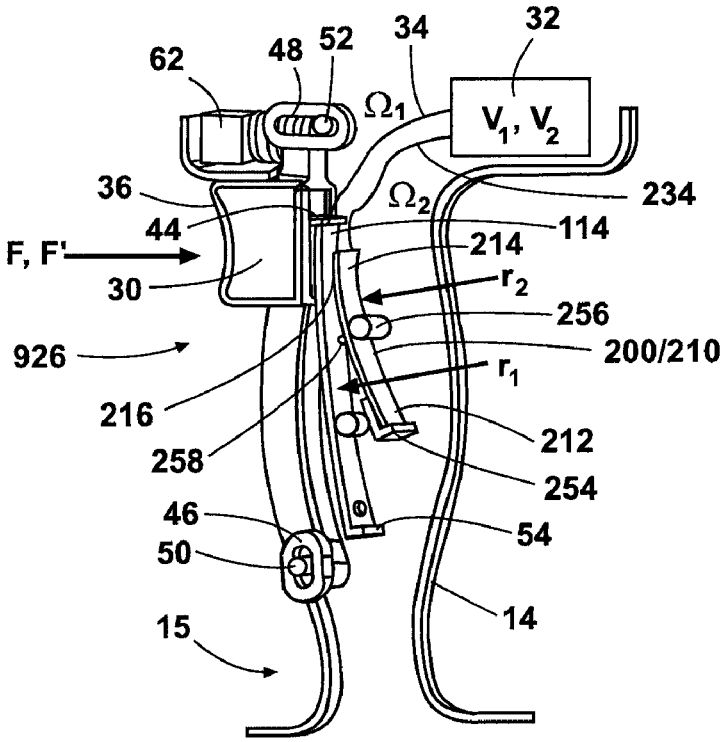
FIG. 11 is a side elevational view of an opposite side of the trigger assembly of FIG. 10.

FIGS. 10 and 11 illustrate a further example trigger assembly 926, which is similar to the trigger assembly 26 depicted in FIGS. 4 and 5. In this example embodiment, the flex sensor 100 is a first flex sensor 100 that includes a first leaf spring 110. The trigger assembly 926 further includes a second flex sensor 200 that includes a second leaf spring 210 connected to the controller 32 by an electrical connection 234.

A second spring support 254 is fixed in the handle 14 to support a supported end 212 of the second flex sensor 200. The free end 114 of the first flex sensor 100 contacts a free end 214 of the second flex sensor 200 at a second engagement point 216. A second pivot 256 can be provided in the handle 14 at a second intermediate position 258 between the second engagement point 216 and the second spring support 254. In another embodiment, the free end 214 of the second flex sensor 200 can be spaced apart from the free end 114 of the first flex sensor 100.

When a user applies the input force (F) to the trigger 30, the force is transferred by the bridge 44 to the first flex sensor 100 at the engagement point 116. As the trigger 30 moves inside the trigger opening 38, the first flex sensor 100 elastically bends at the pivot 56. As the trigger 30 moves further toward the handle 14, the free end 114 of the first flex sensor 100 transfers the input force (F) to the free end 214 of the second flex sensor 200. The second flex sensor 200 elastically bends around the second pivot 256. An increased input force (F') can be required to bend the second flex sensor 200 due to the second leaf spring 210. For example, the increased input force (F') can be required to bend the combination of the first and the second leaf springs 110 and 210 and/or the second leaf spring 210 in isolation. The first and second leaf springs 110 and 210 can provide the return spring force ($F_R$) in combination.

The first flex sensor 100 provides a first variable resistance ($\Omega_1$) to the controller 32. The first variable resistance ($\Omega_1$) increases as the degree of bending increases due to the application of the input force (F) on the trigger 30. The degree of bending is defined similarly to the degree of bending referred to in FIGS. 3 and 17-20. The controller 32 uses the first electrical resistance ($\Omega_1$) to output a first voltage (V1) corresponding to a first control input, such as a variable speed control for the motor 16, i.e. from FIG. 1.

The second flex sensor 200 provides a second variable resistance ($\Omega_2$) to the controller 32. The second variable resistance ($\Omega_2$) increases as the degree of bending of the flex sensor 200 increases due to the application of the increased input force (F') on the trigger 30. The degree of bending of the second flex sensor 200 is defined similarly to the degree of bending referred to in FIGS. 3 and 17-20 only with respect to an outer edge 201 and an engagement point 216 of the second flex sensor 200. The controller 32 uses the second electrical resistance ($\Omega_2$) to output a second voltage ($V_2$) corresponding to a second control input, such as a variable torque control for the motor 16, i.e. from FIG. 1. The second electrical resistance ($\Omega_2$) can also be used to change a condition of a digital output, such as a shift position of the gear set 18 or the clutch 20.

The trigger assembly 926 can also include a limit switch 62. Flex sensors 100 and 200 are generally stable over a wide range of temperatures and over many cycles. The limit switch 62 further reduces the effect of drift in the characteristics of the flex sensors 100 and 200. In an example embodiment, the limit switch 62 detects an initial trigger movement, which initiates the controller 32 to begin sensing the output from the first flex sensor 100. In another example embodiment, the limit switch 62 detects an initial predetermined resistance ($\Omega$) before initializing the controller 32.

Figure 12:
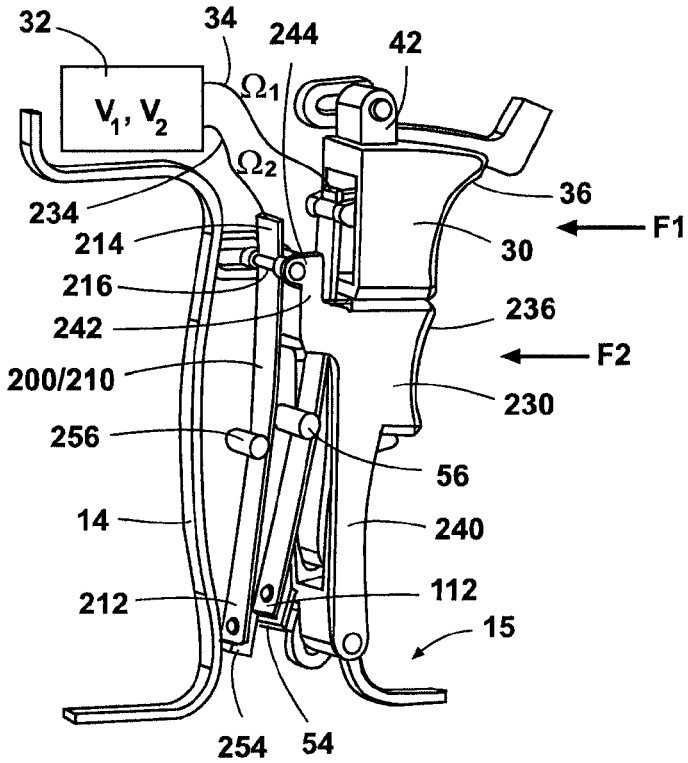
FIG. 12 is a side elevational view of a dual-trigger assembly including two flex sensors according to an example embodiment.
Figure 13:
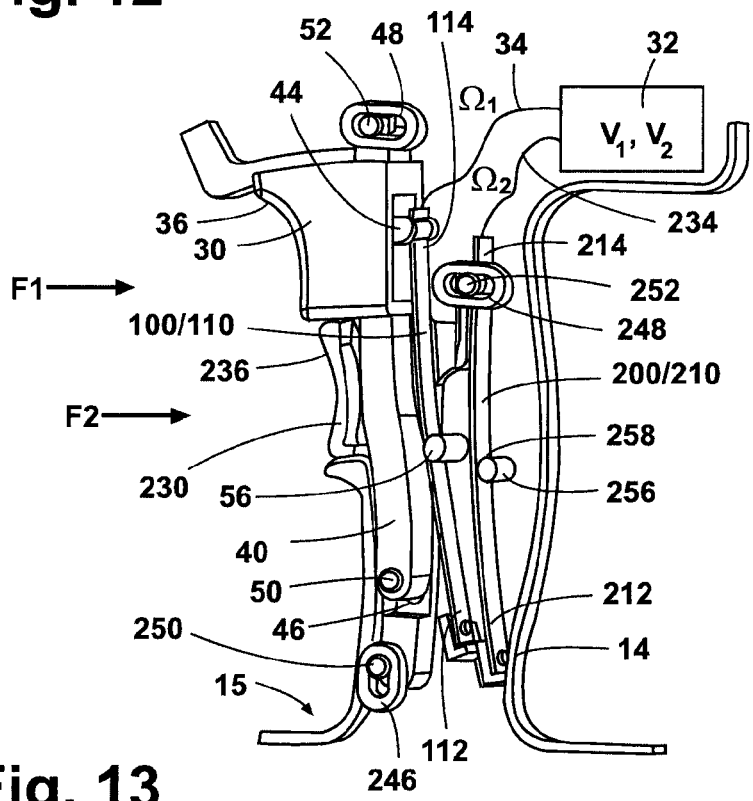
FIG. 13 is a side elevational view of an opposite side of the dual-trigger assembly of FIG. 12.
Figure 14:
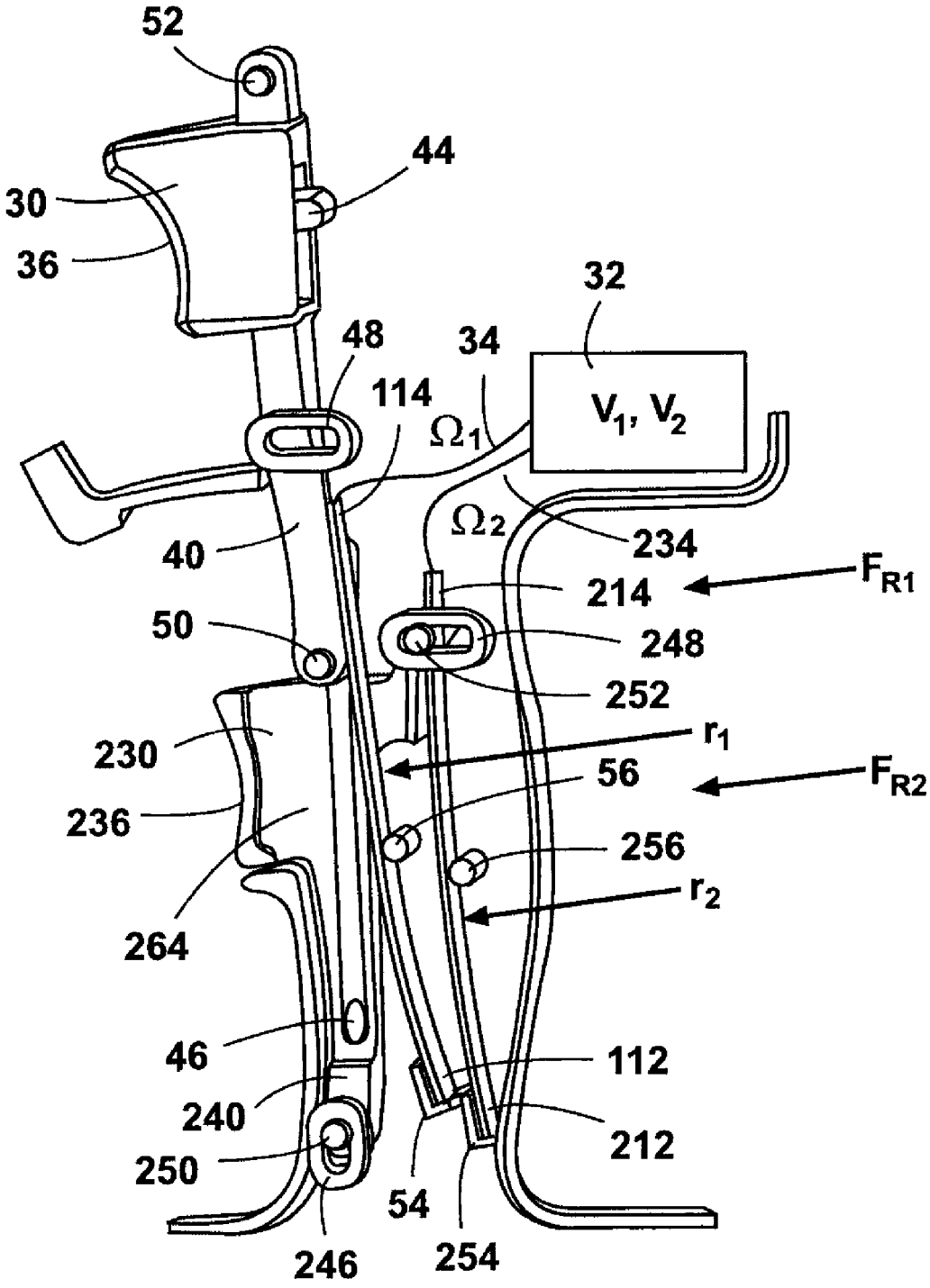
FIG. 14 is a partial exploded view of the dual-trigger assembly of FIG. 12.

FIGS. 12-14 illustrate a further example two-trigger assembly 226. In this embodiment, trigger assembly 226 includes a first trigger 30 associated with the first flex sensor 100. The trigger assembly 226 further includes a second trigger 230 associated with the second flex sensor 200. The two-trigger assembly 226 is similar to the trigger assembly 26 of FIGS. 4 and 5 with respect to the first trigger 30 and the first flex sensor 100. For purposes of clarity, the same reference numbers will be used in the drawings to identify similar elements.

The first flex sensor 100 provides the first variable resistance ($\Omega_1$) to the controller 32. The electrical resistance ($\Omega_1$) of the first flex sensor 100 increases as the first radius of curvature ($r_1$) decreases due to the application of a first input force ($F_1$) on the first trigger 30. The controller 32 uses the first electrical resistance ($\Omega_1$) to output the first voltage ($V_1$) corresponding to the first control input, such as a variable speed control for the motor 16, i.e. from FIG. 1. The first leaf spring 110 can provide a first return spring force ($F_{R1}$).

The second trigger 230 has a second finger support 236 extending outside of the handle 14 through the trigger opening 38. The second finger support 236 allows a user to apply a second input force ($F_2$) to operate the power tool 10. The second trigger 230 also includes a second lower arm 240 extending towards the distal end 15 of the handle 14. The second trigger 230 includes a second upper arm 242 extending towards the drive end 12. Both the second lower arm 240 and the second upper arm 242 support the second trigger 230 in the handle 14. A second bridge 244 projects from the second finger support 236 in a direction substantially transverse to the second lower and second upper arms 240 and 242, respectively. The second bridge 244 transfers the second input force ($F_2$) from the second finger support 236 to the second flex sensor 200.

A first cam slot 246 and a second cam slot 248 are provided in the handle 14. The second lower and the second upper arms 240 and 242 include pins 250 and 252 inserted into the first and second cam slots 246 and 248, respectively. The first and second cam slots 246 and 248 are provided so that the travel path of the second trigger 230 is less arcuate and furthermore creates a more linear trigger motion. For example, if a user applies the second input force ($F_2$) to the second finger support 236, the second trigger 230 pivots about the pin 250 guided by the first cam slot 246. However, rather than pure rotation at the first cam slot 246, some translation also occurs at the first cam slot 246 as the trigger motion is influenced by the pin 252 in the second cam slot 248. The first and second cam slots 246 and 248 also limit the travel of the second trigger 230.

The second trigger 230 further includes a recess 264 in which the first trigger 30 is nested. The second trigger 230 can be shaped and sized to accommodate a full range of movement of both the first and the second triggers 30 and 230. The recess 264 can include the first cam slot 46 extending along the lower arm 240 of the second trigger 230.

The second spring support 254 is fixed in the handle 14 to support the second supported end 212 of the second flex sensor 200. The second bridge 244 of the second trigger 230 can contact the free end 214 of the second flex sensor 200 at the second engagement point 216. The second pivot 256 can be provided in the handle 14 at the second intermediate position 258 between the second engagement point 216 and the second spring support 254. The second flex sensor 200 can extend through the recess 264 in the second trigger 230.

When a user applies the second input force ($F_2$) to the second trigger 230, the force is transferred by the second bridge 244 to the second flex sensor 200 at the second engagement point 216. As the second trigger 230 moves inside the trigger opening 38, the second flex sensor 200 elastically bends to a second radius of curvature ($r_2$), similar to the radius of curvature (r) defined with reference to FIGS. 3 and 17-20. The second pivot 256 guides the direction of the bending and decrease the radius of curvature ($r_2$) (causing a tighter bend) of the second flex sensor 200. The second leaf spring 210 can provide a second return spring force ($F_{R2}$).

The second flex sensor 200 provides the second variable resistance ($\Omega_2$) to the controller 32. The electrical resistance ($\Omega_2$) of the second flex sensor 200 increases as the second radius of curvature ($r_2$) decreases due to the application of a second input force ($F_2$) on the second trigger 230. The controller 32 uses the second electrical resistance ($\Omega_2$) to output a second voltage ($V_2$) corresponding to a second control input, such as a variable torque control for the motor 16, i.e. from FIG. 1.

The first and the second triggers 30 and 230 can be operated independently of each other or simultaneously. The first and second flex sensors 100 and 200 can bend independently of each other depending on the input forces, $F_1$ and $F_2$. In this manner, the variable inputs of the first and the second flex sensors 100 and 200 can be used by the controller 32 to actuate different control inputs of the power tool 10. For example, the first trigger 30 can be used to control the power tool 10 in a forward operating direction while the second trigger 230 can be used to control the power tool 10 in a reverse operating direction. Other tool control inputs can include a variable speed control, a variable torque control, a power take-off control, a clutch control, an impact driver control, a pulse control, a frequency control, and the like.

The power tool 10 includes at least one flex sensor 100 associated with at least one trigger 30. Alternatively, the power tool 10 can include multiple flex sensors 100, 200 associated with multiple triggers 30, 230. In this manner, more than one tool control can be controlled with the finger or fingers of one hand of an operator. The resistances ($\Omega_1$, $\Omega_2$) of the flex sensors 100, 200 can change linearly or non-linearly based on the bending of the flex sensors 100, 200 to the radii of curvature ($r_1$, $r_2$). The controller 32 can interpret the changes in the resistances ($\Omega_1$, $\Omega_2$) and vary at least one control input to the powertool 10.

In addition to added functionality, the power tool 10 can be constructed in a more compact and ergonomic fashion by using any of the trigger assemblies disclosed herein. Power tool handles using trigger assemblies that incorporate flex sensors may be of smaller size than tool handles using existing trigger assemblies which may be bulkier. A using reduced thickness flex sensors in the trigger assemblies, additional free space (S) can be utilized in the handle 14 and/or the drive end 12 for the power source 28, controller 32, and other components.

Figure 15:
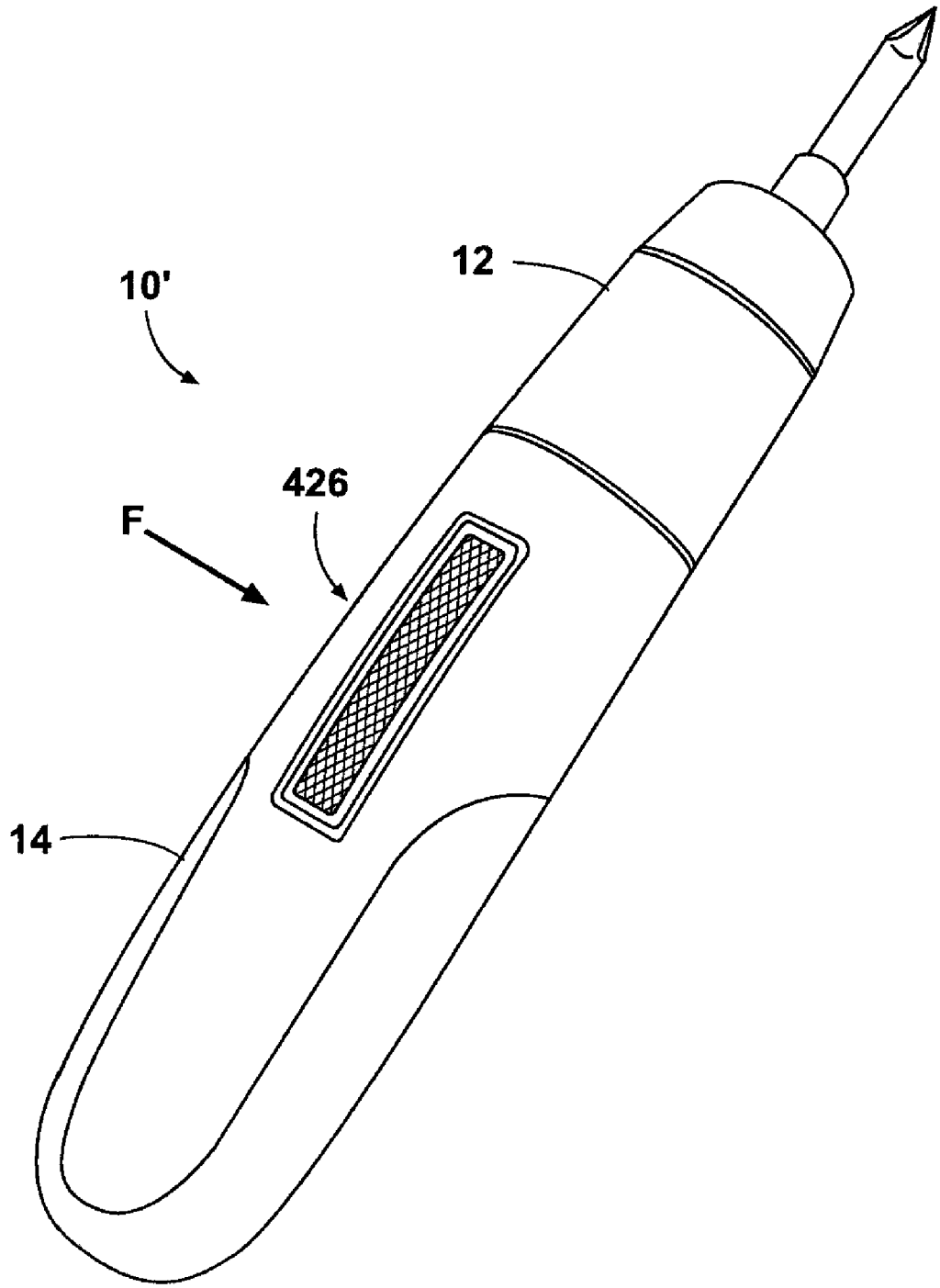
FIG. 15 is a top perspective view of a power screwdriver including another trigger assembly according to another example embodiment.
Figure 16:
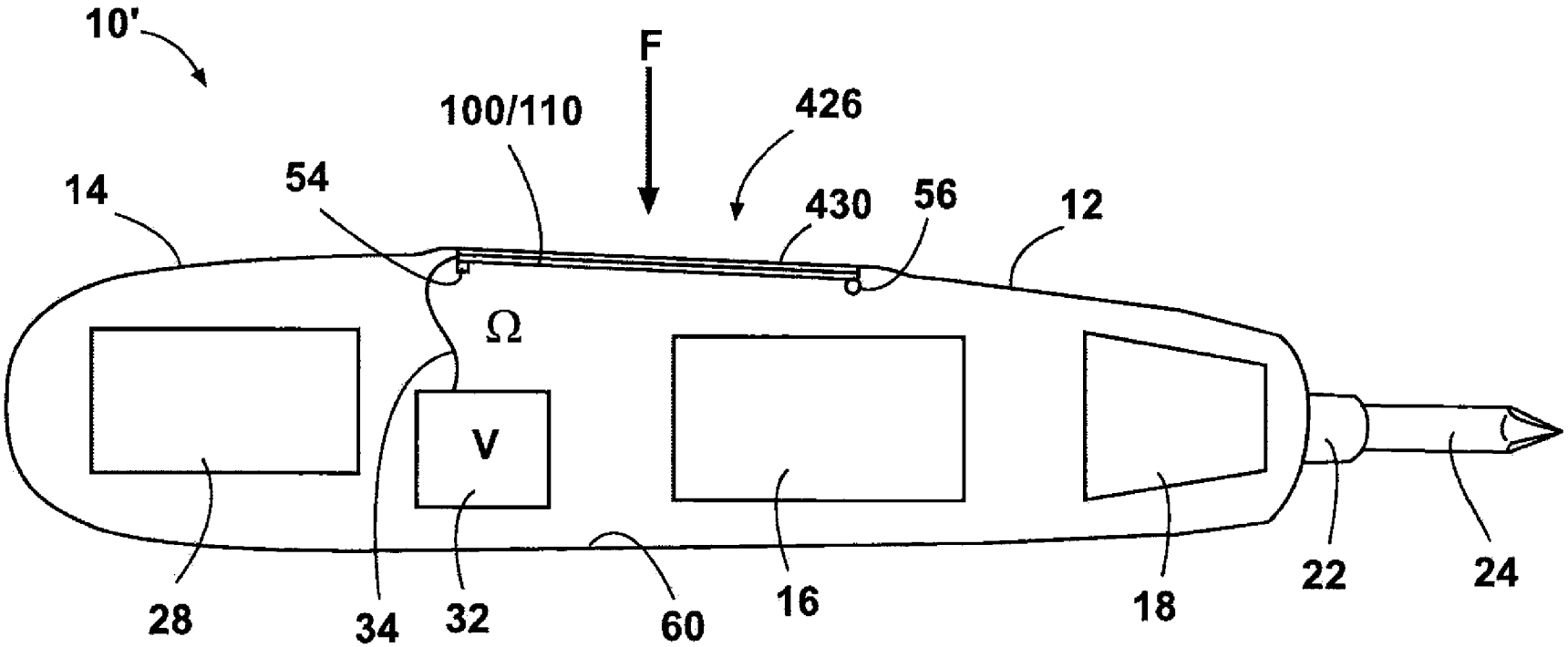
FIG. 16 is a side elevational view of the power screwdriver of FIG. 15.

A trigger assembly 426 can also be used in a motor-grip style power tool 10', such as the power screwdriver depicted in FIGS. 15 and 16. For example, the handle 14 and the drive end 12 are connected in a linear fashion as opposed to the pistol style of FIG. 1. The power source 28, controller 32, motor 16, and gear set 18 are disposed in-line with the bit 24. The trigger assembly 426 is disposed in the tool 10' so that the user can grip a hand around the tool 10' and activate a trigger 430 with a finger or a thumb.

In FIGS. 17 and 18, trigger assembly 426 of the motor-grip power tool 10' can include a push-button style trigger 430 with the flex sensor 100. The trigger 430 can have a trigger support 436 that is a flexible membrane that can stretch based on the input force (F). The trigger 430 can transfer the input force (F) at the engagement point 116 to bend the flex sensor 100 as shown in FIG. 18. The engagement point 116 is located at the intermediate position 58 between a simply supported end 114 and the supported end 112 of the flex sensor 100. The pivot 56 is located at the free end 114 of the flex sensor 100 to guide the bending of the flex sensor 100 towards the inner wall 60 of the power tool 10'. The leaf spring 110 can return the trigger 430 outward from the powertool 10'.

Figure 19:
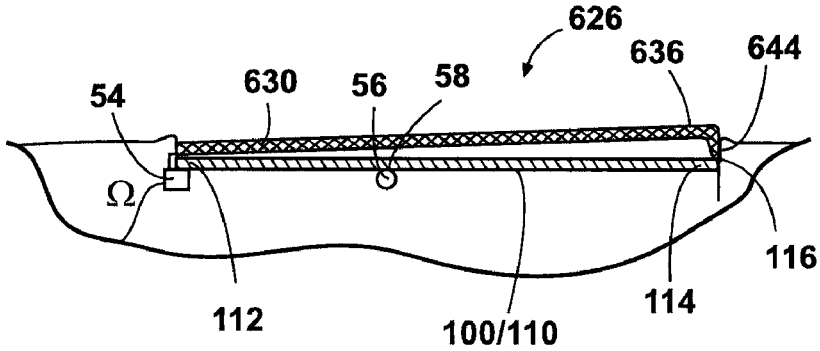
FIG. 19 is a side elevational view of another trigger assembly in a rest position.
Figure 20:
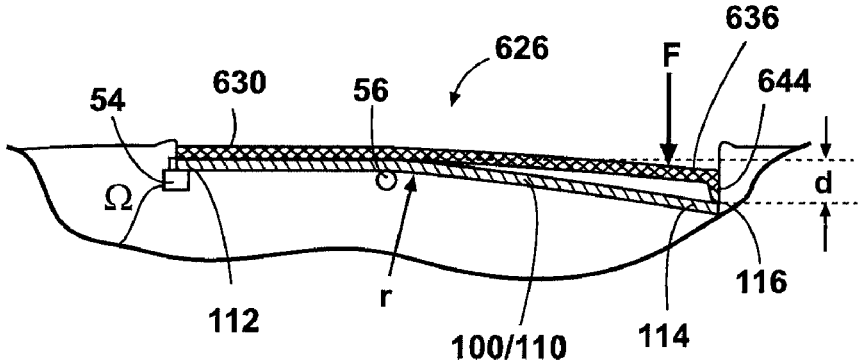
FIG. 20 is a side elevational view of the trigger assembly of FIG. 19 in a bent position.

FIGS. 19 and 20 depict another trigger assembly 626 suitable for the motor-grip power tool 10'. A trigger 630 can be a rigid trigger or a flexible trigger. The trigger 630 has a bridge 644 extending towards the free end 114 of the flex sensor 100. The bridge 644 transfers the input force (F) from a finger support 636 to the flex sensor 100 at the engagement point 116 as shown in FIG. 20.

The triggers 430, 630 create the radius of curvature (r) of the flex sensor 100. The flex sensor 100 creates the variable resistance (Ω) corresponding to the radius of curvature (r) which is used by the controller 32. The electrical resistance (Ω) of the flex sensor 100 increases as the radius of curvature (r) decreases due to the application of the input force (F) on the triggers 430, 630. The controller 32 can use the electrical resistance (Ω) to output the voltage (V) corresponding to a speed control input for the motor 16 or another function of the power tool 10'.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A variable control trigger for a power tool, comprising:

a flexible sensor having an electrical resistance that varies based on a radius of curvature of the flexible sensor; and a trigger connected to the power tool, the trigger operating to mechanically apply a bending force at an engagement point on the flexible sensor to bend the flexible sensor and alter the radius of curvature.

2. The variable control trigger of claim 1, further comprising:

a second flexible sensor having an electrical resistance that varies based on a radius of curvature of the second flexible sensor, the trigger operating to apply a bending force at an engagement point to bend the second flexible sensor and alter the radius of curvature of the second flexible sensor.

3. The variable control trigger of claim 1, further comprising:

a second flexible sensor having an electrical resistance that varies based on a radius of curvature of the second flexible sensor; and a second trigger operating to apply a second bending force at an engagement point to bend the second flexible sensor and alter the radius of curvature of the second flexible sensor.

4. The variable control trigger of claim 1, further comprising a pivot, wherein the pivot guides the flexible sensor around the pivot and decreases the radius of curvature.

5. The variable control trigger of claim 4, wherein the pivot is located between the engagement point and an end of the flexible sensor.

6. The variable control trigger of claim 4, wherein the pivot is located at an end of the flexible sensor.

7. A variable output trigger for a power tool, comprising:

a flexible sensor having a variable electrical resistance based on a bending force applied to the flexible sensor; and a trigger connected to said power tool operating to mechanically apply the bending force at an engagement point on the flexible sensor.

8. The variable output trigger of claim 7, wherein the engagement point is located at an end of the flexible sensor.

9. The variable output trigger of claim 7, further comprising a pivot that guides the flexible sensor around the pivot and decreases the radius of curvature.

10. The variable output trigger of claim 9, wherein the engagement point is between the pivot and an end of the flexible sensor.

11. The variable output trigger of claim 7, wherein the electrical resistance changes as a radius of curvature of the flexible sensor changes in response to the bending force.

12. The variable output trigger of claim 7, wherein the electrical resistance changes as a deflection of the flexible sensor changes.

13. A variable output trigger for a power tool comprising:

a flexible sensor creating a variable electrical resistance based on a deflection of the flexible sensor at an engagement point; and a trigger connected to said power tool operating to mechanically apply a bending force to the flexible sensor at the engagement point.

14. A method for operating a variable trigger of a power tool, the variable trigger assembly including a flexible sensor and a trigger, the method comprising:

applying a force to the trigger connected to said power tool operating to engage the flexible sensor and mechanically transfer the force to the flexible sensor at an engagement point to alter a radius of curvature of the flexible sensor; and varying an electrical resistance of the flexible sensor based on the radius of curvature of the flexible sensor.

15. The method of claim 14, the variable trigger further including a second flexible sensor, further comprising:

varying an electrical resistance of the second flexible sensor based on a radius of curvature of the second flexible sensor.

16. The method of claim 15, further comprising:

applying an increased force to the trigger, wherein the trigger transfers the increased force at an engagement point on the second flexible sensor to alter the radius of curvature of the second flexible sensor.

17. The method of claim 15, the variable trigger further including a second trigger, further comprising:

applying a second force to the second trigger operating engage to the second flexible sensor and transfer the second force to the second flexible sensor at an engagement point on the second flexible sensor to alter the radius of curvature of the second flexible sensor.

18. The variable control trigger of claim 1, further comprising:

a controller configured to output an electrical signal to the power tool based on the electrical resistance of the flexible sensor to control a function of the power tool.

* * * * *